US011104472B2

(12) United States Patent
Messerschmid

(10) Patent No.: US 11,104,472 B2
(45) Date of Patent: Aug. 31, 2021

(54) APPARATUS AND METHOD FOR PRODUCING CONTAINERS FROM PAPER MATERIAL OR PAPER-LIKE MATERIAL, AND CONTAINER

(71) Applicant: Uwe Messerschmid, Albershausen (DE)

(72) Inventor: Uwe Messerschmid, Albershausen (DE)

(73) Assignee: MICHAEL HÖRAUF MASCHINENFABRIK GMBH UND CO. KG, Donzdorf (DE)

( * ) Notice: Subject to any disclaimer, the term of this patent is extended or adjusted under 35 U.S.C. 154(b) by 291 days.

(21) Appl. No.: 15/877,912

(22) Filed: Jan. 23, 2018

(65) Prior Publication Data

US 2018/0215497 A1 Aug. 2, 2018

(30) Foreign Application Priority Data

Feb. 1, 2017 (DE) ..... 10 2017 201 595.0

(51) Int. Cl.
*B65D 3/06* (2006.01)
*B31B 50/64* (2017.01)
(Continued)

(52) U.S. Cl.
CPC ..... *B65D 3/06* (2013.01); *B31B 50/59* (2017.08); *B31B 50/64* (2017.08); *B31B 50/642* (2017.08);
(Continued)

(58) Field of Classification Search
CPC ..... B65D 3/06; B31B 50/642; B31B 50/59; B31B 50/64; B31B 2110/20;
(Continued)

(56) References Cited

U.S. PATENT DOCUMENTS 2,029,827 A * 2/1936 Majer ..... B31B 50/00 493/108
3,063,347 A * 11/1962 Cummings ..... B31C 7/02 493/106
(Continued)

FOREIGN PATENT DOCUMENTS

CN 101117163 A 2/2008
CN 102459010 A 5/2012
(Continued)

OTHER PUBLICATIONS

European Patent Office Search Report issued in European Application No. 18 15 2135 with English translation of category of cited documents dated Jul. 18, 2018 (8 pages).
(Continued)

*Primary Examiner* — Thanh K Truong
*Assistant Examiner* — Scott A Howell
(74) *Attorney, Agent, or Firm* — Flynn Thiel, P.C.

(57) ABSTRACT

An apparatus for producing containers from paper or paper-like material. The container has a lateral surface made of a wound sheet-like segment, of which segment edges arranged on longitudinal sides overlap and form a region of overlap, and a pan-like termination element. The lateral surface and the termination element are connected to one another in an essentially liquid-tight manner by a skirt, and at least one pressing ram is provided for pressing and sealing the skirt, the pressing ram subjecting the skirt to essentially radially directed pressure. The pressing ram has a radially projecting protrusion in a portion provided for the purpose of acting on a boundary portion of the region of overlap of the lateral surface of the skirt.

16 Claims, 7 Drawing Sheets

(51) Int. Cl.

| | |
|---|---|
| ***B31C 7/06*** | (2006.01) |
| ***B31B 50/59*** | (2017.01) |
| ***B31F 1/00*** | (2006.01) |
| ***B31B 110/10*** | (2017.01) |
| ***B31B 110/20*** | (2017.01) |
| ***B31B 105/00*** | (2017.01) |

(52) U.S. Cl.
CPC ..... *B31C 7/06* (2013.01); *B31F 1/0083* (2013.01); *B31F 1/0087* (2013.01); *B31F 1/0093* (2013.01); *B31B 2105/0022* (2017.08); *B31B 2110/10* (2017.08); *B31B 2110/20* (2017.08)

(58) Field of Classification Search
CPC ..... B31B 2110/10; B31B 2105/0022; B31C 7/06; B31F 1/0083; B31F 1/0087; B31F 1/0093
USPC ..... 493/153
See application file for complete search history.

(56) References Cited

U.S. PATENT DOCUMENTS

| | | | | | |
|---|---|---|---|---|---|
| 3,343,465 | A * | 9/1967 | Albert | B31D 1/005 | 493/106 |
| 3,438,824 | A * | 4/1969 | Balamuth | B29C 66/542 | 156/69 |
| 4,100,842 | A * | 7/1978 | Richards | B31D 1/005 | 271/117 |
| 4,571,233 | A * | 2/1986 | Konzal | B31B 50/00 | 279/2.14 |
| 5,035,106 | A * | 7/1991 | Haase | B65B 7/285 | 53/470 |
| 5,083,994 | A * | 1/1992 | Seufert | B65D 25/54 | 220/662 |
| 5,556,364 | A * | 9/1996 | Konzal | B31F 1/009 | 413/31 |
| 5,569,143 | A * | 10/1996 | Konzal | B31D 1/005 | 156/69 |
| 5,624,367 | A * | 4/1997 | Budziszewski | B31D 1/005 | 493/109 |
| 5,705,239 | A * | 1/1998 | Andersen | B28B 23/0087 | 428/34.5 |
| 7,686,753 | B2 * | 3/2010 | Konzal | B31D 1/005 | 493/157 |
| 7,926,535 | B2 | 4/2011 | D'Amato | | |
| 8,234,999 | B2 * | 8/2012 | Messerschmid | B31B 50/00 | 118/323 |
| 8,336,186 | B2 * | 12/2012 | Bloome | B29C 66/82261 | 29/509 |
| 8,453,698 | B2 * | 6/2013 | D'Amato | B21D 51/34 | 156/498 |
| 8,727,206 | B2 | 5/2014 | Messerschmid et al. | | |
| 10,377,088 | B2 * | 8/2019 | Poell | B29C 66/1122 | |
| 2007/0137030 | A1 | 6/2007 | D'Amato | | |
| 2008/0035712 | A1 | 2/2008 | D'Amato | | |
| 2012/0048918 | A1 | 3/2012 | Hougland et al. | | |
| 2012/0125926 | A1 | 5/2012 | Iyori et al. | | |
| 2015/0352780 | A1 | 12/2015 | Messerschmid | | |

FOREIGN PATENT DOCUMENTS

| | | | |
|---|---|---|---|
| CN | 203254705 | U | 10/2013 |
| CN | 105151451 | A | 12/2015 |
| DE | 32 40 811 | A1 | 5/1984 |
| DE | 4406886 | A1 | 9/1995 |
| DE | 10 2006 057 531 | A1 | 6/2007 |
| DE | 10 2014 210 960 | A1 | 12/2015 |
| EP | 2080715 | B1 | 7/2009 |
| GN | 1894137 | A | 1/2007 |

OTHER PUBLICATIONS

Office Action of German Patent Office issued in German Application No. 10 2017 201 595.0 dated Aug. 31, 2017 (8 pages).
Chinese Office Action with English Translation issued in corresponding Chinese Application No. 201810102141.2 dated Apr. 29, 2020 ( 16 pages).
Chinese Office Action with partial English Translation issued in corresponding Chinese Application No. 201810102141.2 dated Jun. 3, 2021 (8 pages).

* cited by examiner

APPARATUS AND METHOD FOR PRODUCING CONTAINERS FROM PAPER MATERIAL OR PAPER-LIKE MATERIAL, AND CONTAINER

CROSS-REFERENCE TO RELATED APPLICATIONS

This claims priority from German Application No. 10 2017 201 595.0, filed on Feb. 1, 2017, the disclosure of which is hereby incorporated by reference in its entirety.

FIELD, BACKGROUND AND SUMMARY OF THE INVENTION

The invention relates to an apparatus and a method for producing containers from paper material or paper-like material and to a multi-part container made of paper material or paper-like material. An apparatus for producing containers from paper material or paper-like material, wherein the container has a lateral surface made of a wound sheet-like segment, of which the segment edges arranged on the longitudinal sides overlap and thus form a region of overlap, and also has a pan-like termination element, that is to say a pan-like base and/or a pan-like lid, wherein the lateral surface and the termination element are connected to one another in an essentially liquid-tight manner by means of a skirt, and has at least one pressing ram for the purpose of pressing and sealing the skirt, the pressing ram subjecting the skirt to essentially radially directed pressure.

Examples of paper material or paper-like material here are paper, cardboard or paperboard or also sheet-like plastic materials, also plastic laminates. For example, it is possible for paper, cardboard or paperboard to be present in sheet-like segments, and these sheet-like segments can then, on the one hand, be wound to form a conical sleeve and, on the other hand, deformed to form a pan-like base. The paper material is expediently coated in a liquid-tight manner. It is also the case that sheet-like plastic materials are processed into cups in the same way as, or at least in a similar way to, paper material. Plastic laminates are also examples of sheet-like plastic materials. The sheet-like plastic material here, which is present in segment form, is likewise wound around a winding mandrel and connected in the region of the overlap in order to form a conical sleeve. It is also possible for a pan-like base or pan-like lid to be formed from the sheet-like plastic material, by a circular blank having its peripheral region folded approximately vertically upwards in relation to a base surface or lid surface. The problems which occur in the case of plastic material which is to be processed in a manner similar to paper are essentially the same here as those which occur when paper material is being processed. The present invention can be used for plastic materials which are to be processed in a manner similar to paper, but is not intended specifically for plastic materials which are to be processed in a manner similar to paper; rather, it can also be used to considerable advantage for paper material. The invention is intended to improve an apparatus and a method for producing containers from paper material or paper-like material, and a multi-part container made of paper material or paper-like material, in respect of the sealing of the skirt.

The invention provides, for this purpose, an apparatus for producing containers from paper material or paper-like material, the container having a lateral surface made of a wound sheet-like segment, of which segment edges arranged on longitudinal sides of the sheet-like segment overlap and thus form a region of overlap, and also having a pan-like termination element, that is to say a pan-like base and/or a pan-like lid. The lateral surface and the termination element are connected to one another in an essentially liquid-tight manner by means of a skirt, wherein at least one pressing ram is provided for the purpose of pressing and sealing the skirt, the pressing ram subjecting the skirt to essentially radially directed pressure. In a portion of the pressing ram provided for the purpose of acting on a boundary portion of the region of overlap of the lateral surface on the skirt, the pressing ram has a radially projecting protrusion. The boundary portion is defined by the segment edge of the sheet-like segment which is covered by the sheet-like segment and a small area ahead of the segment edge and behind the segment edge, when seen in the peripheral direction of the sleeve. This boundary portion of the region of overlap does at least cover an area from the lower or covered segment edge, which is covered by a region of the segment lying on top of it, to a region where the segment lying on top of the segment edge is again arranged on the same height of the segment edge. As a consequence, this boundary portion of the region of overlap does also cover a small step-like portion outside the region of overlap.

By means of a radially projecting protrusion, part of the region of overlap can be subjected to an increased pressure and, as a result, there are no cavities present within the pressed skirt, even in the region of overlap. It has been found that, in the case of conventionally produced multi-part containers, it is precisely the boundary portion of the region of overlap in the region of the skirt which is responsible for leakages. This is because, along the segment edge which rests on the outer side of the termination element, for example of the collar of the base or of the collar of a lid, a cavity is inevitably produced by the inner segment edge and the segment located above the same. This cavity lies within the boundary portion of the region of overlap. In the case of conventional apparatuses and methods, and in the case of conventional containers, this cavity is not completely filled when the skirt is subjected to pressing action. This cavity may have a connection to the interior of the cup, and therefore a leakage point is then formed. By means of the apparatus according to the invention, the skirt is pressed together in the area of one or even both segment edges of the region of overlap to such a pronounced extent that the cavity which is still present along the segment edge prior to the pressing operation is completely filled with sealing material. It is preferably the case that increased pressure is applied merely to the boundary portion of the region of overlap where the inner segment edge, which is also accessible from the interior of the container, rests on the outer side of the termination element. This means that the skirt is also completely liquid-tight in the region of overlap. The radially projecting protrusion is provided here usually on a cross-sectionally circle-segment-shaped pressing surface, beyond which the protrusion then projects in the radial direction. The height of the pressing surface usually corresponds to the height of the skirt. The pressing surface can also be divided up over a plurality of circle-segment-shaped strips, then either all, or just some, of these having a protrusion which projects in the radial direction. The depression which is then produced on the inner side of the skirt by such a pressing ram is in the form of a groove, and it is possible for a plurality of grooves to be impressed over the height of the skirt. It is significant then, in the case of such groove-form impressions, that there is no longer any cavity present on the inner segment edge in the region of the impressed grooves. If there are still cavities present between the groove-form impressions, this no longer affects the sealing of the skirt.

In a development of the invention, the pressing ram is arranged on a radially inner side of the skirt and the protrusion projects radially outwards. In particular, the depression impressed by the protrusion on the pressing ram is arranged on the barely visible inner side of the skirt.

Arranging the pressing ram with the at least one protrusion on a radially inner side of the skirt has proven to be advantageous.

In a development of the invention, a radially outer surface of the protrusion is curved convexly.

The convex curvature may be adapted to a curvature on the inner side of the skirt, and therefore the curvature of the protrusion corresponds essentially to the radius of curvature of the skirt. This makes it possible to generate a uniform pressure, as seen over the width of the protrusion.

In a development of the invention, the protrusion projects in the radial direction beyond the rest of the surface of the pressing ram by a height which is between 0.5 times and 1.5 times, in particular is equal to, the thickness of the sheet-like segment for the lateral surface.

This makes it possible to introduce an increased pressure without there being any risk of the pressing ram damaging the lateral-surface material to which the pressure is applied. In the case of excessive pressure, the pressing ram could possibly damage the material, which could then, in turn, result in leakages.

In a development of the invention, the protrusion extends in the circumferential direction over a width which is between 0.25 times and 0.75 times, in particular is 0.5 times, the width of the region of overlap in the circumferential direction.

It has proven to be advantageous if the increased pressure, rather than being applied over the entire width of the region of overlap, is applied only over part of the width of the region of overlap, in the area of one or both segment edges of the region of overlap. The absolute value of the pressure can thus be selected to be lower, and sufficient sealing can nevertheless be achieved.

In a development of the invention, the protrusion is arranged circumferentially in relation to the region of overlap such that only one of the segment edges of the lateral surface in the region of overlap is subjected to an increased pressure.

In order to achieve full, thorough sealing of the skirt in the region of overlap, it is sufficient to apply increased pressure merely to one of the segment edges in the boundary portion of the region of overlap. The segment edge selected here is advantageously the inner segment edge of the region of overlap, said segment edge butting against the termination element. This inner segment edge, which butts against the termination element, extends into the interior of the container, and a cavity in front of this segment edge can therefore result in liquid which is contained in the container penetrating into the skirt.

The protrusion is advantageously arranged symmetrically in relation to a periphery of the region of overlap.

This can achieve reliable pressing in the region of said segment edge, and it is possible to achieve, in particular, the situation where a cavity in front of said segment edge is completely filled with sealing material during the pressing operation. The boundary portion of the region of overlap is not only defined by the inner segment edge, but by the point at which the segment portion resting on the inner segment edge comes into contact with the termination element again. Prior to the skirt being subjected to pressing action, this is the end of the cavity in front of the inner segment edge.

The protrusion is preferably arranged such that it acts on that segment edge of the region of overlap which butts against the outer side of the termination element. The segment edge butting against the outer side of the termination element extends into the interior of the container. In the region of this segment edge, it is therefore particularly important for no cavity to be left in front of the segment edge once the skirt has been subjected to pressing action. Arranging the protrusion symmetrically in relation to a periphery of the region of overlap makes it possible to achieve a situation where the cavity in front of said segment edge is completely filled with sealing material when the skirt is subjected to pressing action.

In a development of the invention, the pressing ram has a counterpart located opposite it, wherein the skirt is accommodated between the counterpart and the pressing ram, and wherein the counterpart has a depression in the region in which the region of overlap ends up located, in other words the region in which the region of overlap is placed.

A depression can prevent damage caused by excessive or non-uniform pressure.

In a development of the invention, a width of the depression in the circumferential direction is 0.5 times to 1.5 times the width of the region of overlap.

This avoids an excessive pressure precisely in the region of overlap, where there are more material layers located one upon the other than in the rest of the outer lateral surface. The depression may have rounded side edges, to avoid pressure points and damaged material in the region of the skirt. If the depression is less than equal to the width of the region of overlap, it is not usually the case that the depression is arranged opposite the protrusion.

In a development of the invention, a depth of the depression is 0.75 times to 1.25 times, in particular is equal to, the thickness of the sheet-like segment for the lateral surface.

The invention also provides a method for producing a container from paper material or paper-like material, having the following steps: winding a sheet-like segment to form a lateral surface, the segment edges arranged on the longitudinal sides therefore overlapping and thus forming a region of overlap, connecting a pan-like termination element, that is to say a pan-like base and/or a pan-like lid, to the lateral surface by means of a skirt, the lateral surface and the termination element therefore being connected to one another in an essentially liquid-tight manner, pressing and sealing the lateral surface and the termination element in the region of the skirt using at least one pressing ram, the skirt therefore being subjected to essentially radially directed pressure, and subjecting at least one boundary portion of the region of overlap of the lateral surface in the region of the skirt to a pressure which is higher than that over the rest of the skirt.

Applying an increased pressure in at least one boundary portion of the region of overlap during the operations of pressing and sealing the skirt can reliably avoid leakage points.

In a development of the invention, the increased pressure is applied by means of a radially projecting protrusion on the pressing ram.

The protrusion projects from the rest of the pressing surface of the ram. The pressing surface may also be formed by means, of a plurality of strip-like protrusions, all, or even just some, of which then have a radially projecting protrusion. The pressing surface may be, for example, circle-segment-shaped in cross section, wherein the protrusion then projects from said circle-segment-shaped pressing surface.

A development of the invention provides for the increased pressure to be applied to a region which is on the inner side of the skirt and is located opposite the inner segment edge of the lateral surface, said segment edge resting on the outer side of the termination element.

Said inner segment edge, which rests on the outer side of the termination element, continues into the interior of the container and thus comes into contact with a liquid which may be located in the container. If then, according to the invention, this inner segment edge is subjected to the increased pressure, cavities, and therefore leakage points, in this region can be reliably avoided.

In a development of the invention, the region which is subjected to increased pressure is arranged symmetrically in relation to that periphery of the region of overlap on which is arranged the inner segment edge of the lateral surface, said segment edge resting on the outer side of the termination element.

This can achieve a reliable pressing action and, specifically, can achieve the situation where a cavity which is formed in front of the inner segment edge of the lateral surface is completely filled with sealing material during the pressing operation.

A development of the invention provides for the skirt to be subjected to the increased pressure in a region of which the width corresponds to 0.25 times to 0.75 times, in particular to 0.5 times, the width of the region of overlap.

Since therefore only part of the width of the region of overlap is subjected to the increased pressure, the absolute value of the pressure can be selected to be smaller, and liquid-tight pressing of the skirt is nevertheless reliably made possible.

The invention also provides a multi-part container made of paper material or paper-like material, the container having a lateral surface which is formed from a wound sheet-like segment, of which the lateral segment edges, in the wound state, are arranged in a region of overlap, and having a pan-like termination element, that is to say a pan-like base and/or a pan-like lid, wherein the lateral surface and the termination element are connected in an essentially liquid-tight manner by means of a skirt, wherein, in the region of the skirt, the lateral surface and the termination element are pressed together and sealed to one another, wherein, in a boundary portion of the region of overlap, an interspace which is formed between the segment edge resting on the outer side of the termination element and that portion of the segment of the lateral surface which rests on the segment edge is completely filled with a sealing material, and wherein a pressed-in depression is provided on the inner side of the skirt, in the region opposite the segment edge which rests on the outer side of the termination element.

Since this interspace, which usually has a connection to the interior of the cup prior to the skirt being subjected to pressing action, is completely filled with a sealing material in the region of the skirt, it is possible to achieve in a reliable manner the situation where, in the region of said segment edge, there is no liquid entering into the skirt from the interior of the container. The fact that this interspace is completely filled with sealing material is ensured by an increased pressure in this region, the increased pressure resulting in a pressed-in depression on the inner side of the skirt.

In a development of the invention, a width of the depression in the circumferential direction is between 0.25 times and 0.75 times, in particular is 0.5 times, the width of the region of overlap.

In a development of the invention, a depth of the depression is 0.5 times to equal to the material thickness of the segment of the lateral surface.

In a development of the invention, the depression is arranged symmetrically in relation to that periphery of the region of overlap on which is arranged the inner segment edge, which rests on the outer side of the termination element.

BRIEF DESCRIPTION OF THE DRAWINGS

Further features and advantages of the invention can be gathered from the claims and from the following description of preferred embodiments of the invention in conjunction with the drawings. Individual features of the different embodiments illustrated can be combined with one another in any desired manner here without departing from the framework of the invention. In the drawings:

DETAILED DESCRIPTION

Figure 1:
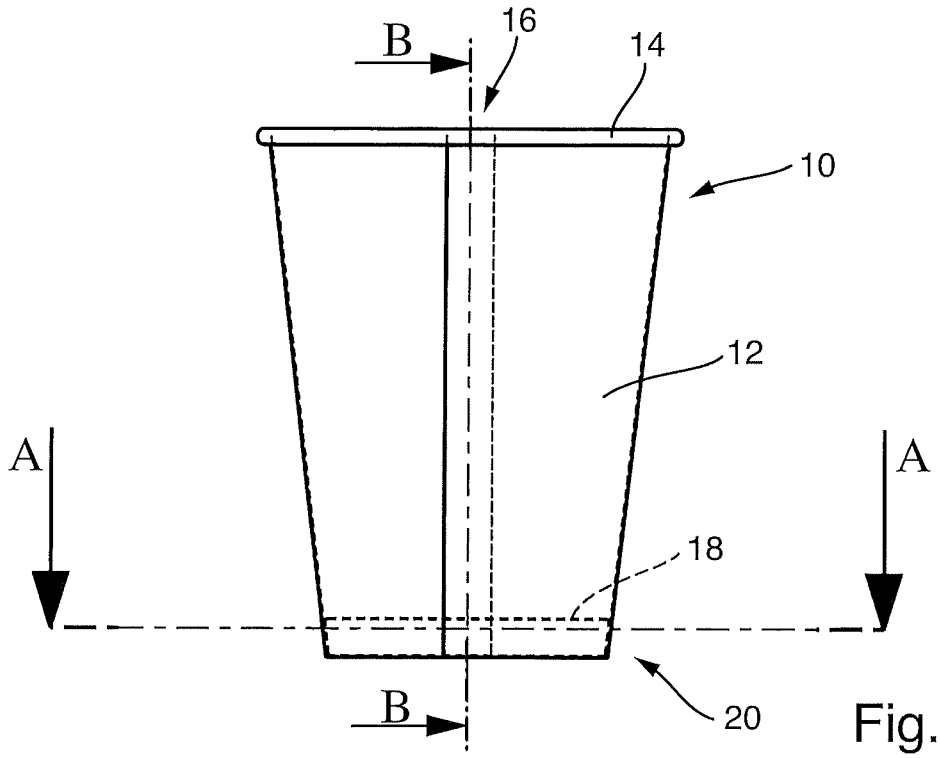
FIG. 1 shows a side view of a cup according to the invention.

The illustration of FIG. 1 shows a side view of a container according to the invention, which in this case is designed in the form of a cup 10. The cup 10 has a frustoconical lateral surface 12, which is provided with a so-called rolled rim 14 on its upper periphery. The lateral surface 12 is formed by virtue of a sheet-like segment being wound, as is illustrated for example in FIG. 2 and FIG. 3. The longitudinal edges of this segment are positioned one above the other during the winding operation to form a region of overlap 16. Following the winding operation, the lateral surface 12 has a frustoconical shape.

At its lower end, the cup 10 is provided with a termination element in the form of a base 18. The base 18 is of approximately pan-like configuration. The base 18 is formed from a for example disc-like paper segment, of which the peripheries are folded downwards through 90°, or somewhat more than 90°, and thus form a base collar 24 which projects approximately vertically downwards from a base plate 22, see FIG. 1*a*.

The lower end of the lateral surface 12 is folded over through 180° around said collar 24 of the base 18. The base collar 24 and the lateral surface 12, which is folded over around the base collar 24, are then first of all heated up by means of hot air and are subsequently pressed together. The paper material of the base 18 and of the lateral surface 12 is provided at least on one side with a plastic coating, for example polyethylene. The thermoplastic coating is heated and, when the lateral surface 12 and base 18 are subjected to pressing action, the lateral surface 12 and base 18 are then sealed to one another in the region of the so-called skirt 20. This takes place in that the heated polyethylene coatings, or coatings made of some other suitable thermoplastic material, are fused together and thus connect the lateral surface 12 and the base 18 to one another in an essentially liquid-tight manner in the region of the base collar 24, or more specifically in the region of the skirt 20.

Figure 1A:
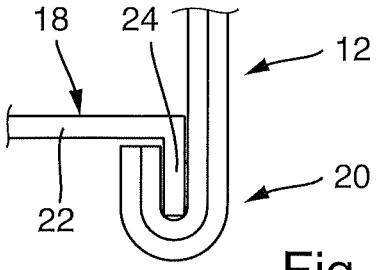
FIG. 1*a* shows a partial sectional view taken along section plane B-B in FIG. 1.

FIG. 1*a* shows a partial sectional view taken along section plane B-B from FIG. 1. The section plane B-B is positioned here in the region of overlap 16, that is to say in which the lateral surface 12 comprises two material layers located one upon the other. It can clearly be seen that the base 18 has the baseplate 22 and the base collar 24, which projects approximately vertically downwards from the baseplate 22. The lower end of the lateral surface 12 has been folded around the base collar 24. In the region of the overlap 16, two material layers of the sheet-like segment, from which the lateral surface 12 is formed, are located one above the other both on the inner side and on the outer side of the base collar 24.

Figure 2:
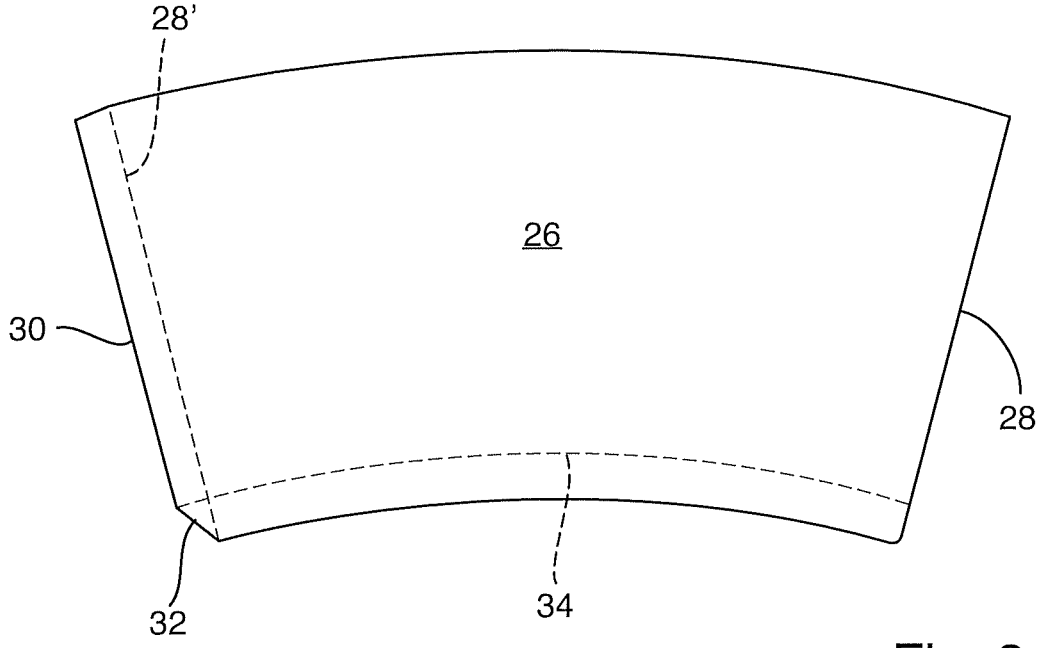
FIG. 2 shows a plan view of a first embodiment of a sheet-like segment for forming a lateral surface by winding action.

FIG. 2 shows a plan view of a first embodiment of a sheet-like segment 26 for a cup 10. The segment 26 is wound onto a conical or frustoconical mandrel to give the frustoconical lateral surface 12. The segment 26 has a first side edge 28 and a second side edge 30. The segment 26 is wound to form an overlap, and therefore the first side edge 28 then passes into the position 28', which is depicted by dashed lines in FIG. 2. At its lower end in FIG. 2, the side edge 30 merges into a bevel 32. The bevel 32 serves to space apart circumferentially from one another the part of the segment edge resting on the inner side of the base collar 24 and the part resting on the outer side of the base collar 24. The lateral surface 26 is folded over around the lower end of the base collar 24 here approximately in the region of the dashed line 34.

Figure 3:
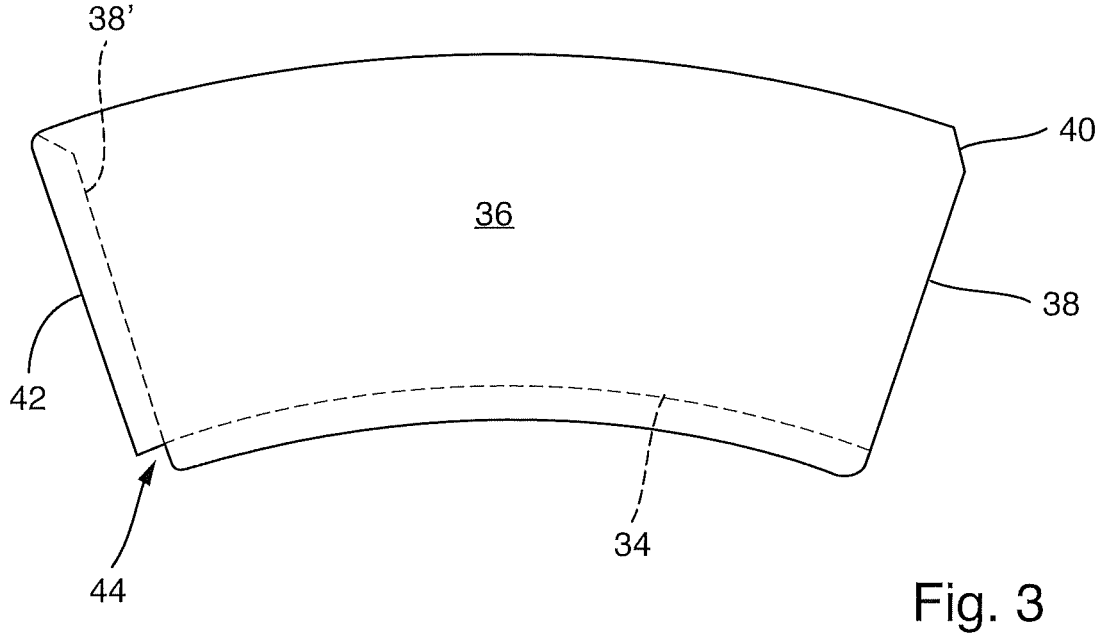
FIG. 3 shows a second embodiment of a sheet-like segment for forming a lateral surface by winding action.

The illustration of FIG. 3 shows a further embodiment of a segment 36 for a cup according to the invention. A first side edge 38 here has a bevel 40 at its upper end, and a second side edge 42 is provided with a recessed corner 44 at its lower end. The recessed corner 44 serves to space apart circumferentially from one another, when the lower end of the lateral surface is being folded over, the part of the segment edge resting on the inner side of the base collar 24 and the part resting on the outer side of the base collar 24. Similarly, the bevelled end 40 of the first side edge 38 also provides for the rolled rim 14 to be readily formed in the region of overlap.

Instead of a rolled rim 14 being formed, it is also possible for the upper end of the lateral surface 12 to be folded over around a collar of a lid. This is done in the case of containers according to the invention which are designed in the form of cans. A lid would then be inserted into the lateral surface in the same way as the base 18, but precisely the other way up, in which case the lid collar then projects upwards from a lid plate and the upper end of the lateral surface would then be folded through 180° around said lid collar, and the lid collar and the upper folded-over end of the lateral surface would then be pressed and sealed to form a skirt.

Figure 4:
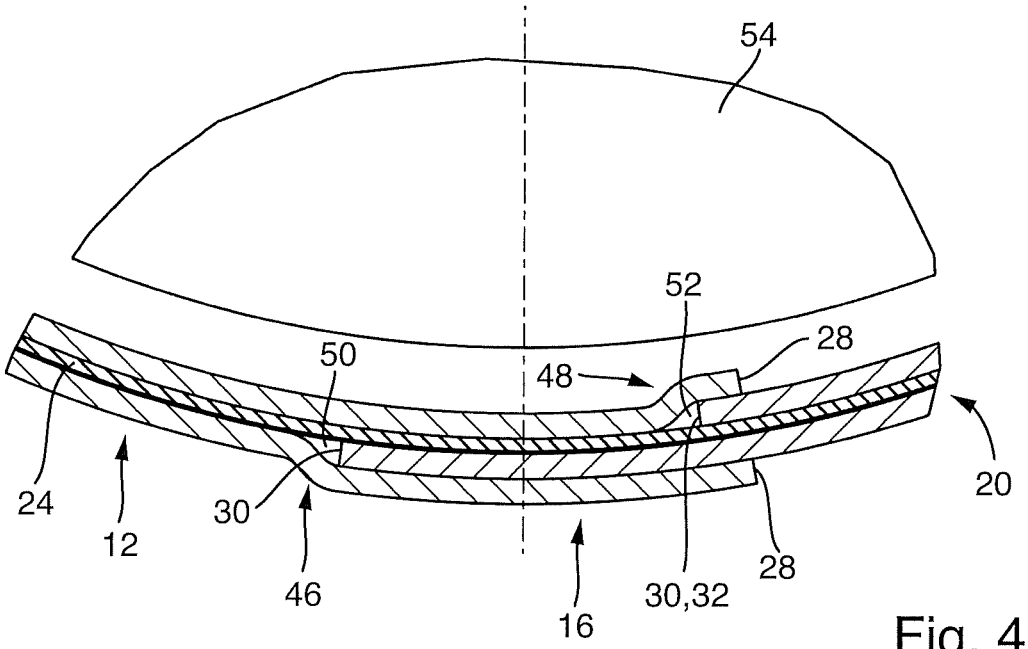
FIG. 4 shows a partial view taken along section plane A-A in FIG. 1 with a pressing ram according to the prior art prior to the skirt being subjected to pressing action.

The illustration of FIG. 4 shows a partial view taken along section plane A-A in FIG. 1 prior to the skirt 20 being subjected to pressing action. The section plane A-A is illustrated in the region of overlap 16. The lateral surface 12, see also FIG. 1*a*, has had its lower end folded around the end of the base collar 24. The second segment edge 30 rests on an outer side of the base collar 24 and then runs by way of the bevel 32, not visible in FIG. 4, circumferentially to the right. On the inner side, the second segment edge 30, on account of the bevel 32, then butts against the inner side of the base collar 24 in a circumferentially spaced-apart state from the other part of the second segment edge 30.

The first segment edge 28, on the outer side of the base collar 24, is spaced apart radially from the base collar 24, and it is also the case on the inner side of the base collar 24 that the first segment edge 28 is spaced apart from the base collar 24. Both on the inner side and the outer side of the base collar 24, that region of the segment which adjoins the first segment edge 28 has a step-like region 46, 48. This region 46 on the outer side of the base collar 24 and also the region 48 on the inner side of the base collar 24 are each arranged in the region of the second segment edge 30 and also belong to the region of overlap. The region of overlap 16 terminates in FIG. 4, on the one hand, at the first segment edge 28 and, on the other hand, at the second segment edge 30. However, a boundary portion of the region of overlap includes the step-like region 46 and the cavity 50 in front of the second segment edge 30, that is to say in other words the boundary portion ends at the point or the line at which the step-like region 46 terminates and the segment rests again on the outer side of the base collar 24.

It can clearly be seen in the illustration of FIG. 4 that, in the step-like region 46, there is the cavity 50 located in front of the second segment edge 30. This cavity 50 has an approximately triangular cross section and is produced by the step-like region 46.

FIG. 4 shows the state of the skirt 20 in the region of the overlap 16 prior to being pressed and sealed. It should be stated here that, prior to the pressing operation, the cavity 50 is in connection with the interior of the cup 10, since the second segment edge 30 extends into the interior of the cup 10. During the pressing operation, the attempt is made either to push this cavity 50 together or to fill it completely with sealing material, that is to say the molten PE coating of the material of the lateral surface 12 and/or of the base 18. If this does not succeed, then the cavity 50 constitutes a potential leakage point, via which liquid can then pass out of the interior of the cup 10 into the region of the skirt 20.

On the inner side of the base collar 24, there is likewise an approximately triangular cavity 52 located in front of the inner segment edge 30, 32. This cavity is less critical since it is located on the inner side of the skirt 20 and, in the pressed and sealed state of the skirt 20, consequently is not in connection with the interior of the cup 10. In the non-pressed state of FIG. 4, however, the cavities 50, 52 merge into one another since they are located in front of the inner segment edge 30, 32 which has been folded around the lower periphery of the base collar 24, cf. also FIG. 1*a*.

FIG. 4 shows a conventional pressing ram 54 on the radially inner side of the skirt 20. This conventional pressing ram 54 is moved radially outwards, that is to say downwards in FIG. 4, in order to press and to seal the skirt 20. It is usual to provide a plurality of circle-segment-shaped pressing rams 54 which, arranged on the inner side of the skirt 20, are then moved radially outwards. However, it is difficult for the skirt 20 to be formed in a liquid-tight manner.

Figure 5:
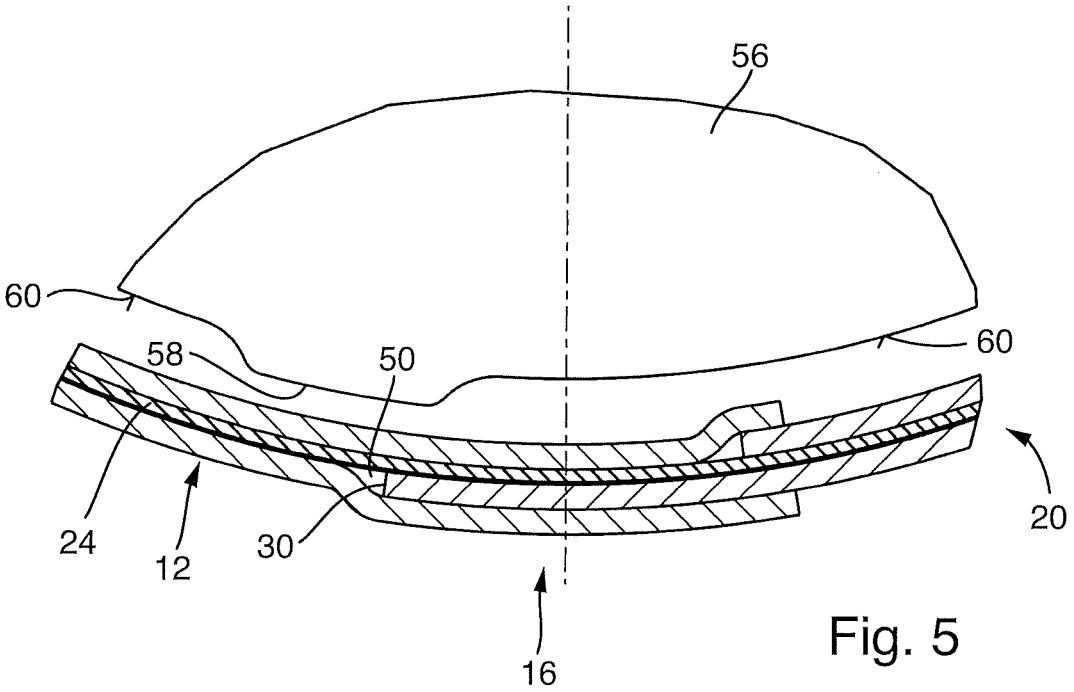
FIG. 5 shows a partial view taken along section plane A-A from FIG. 1 with a pressing ram according to the invention prior to the skirt being subjected to pressing action.

FIG. 5 shows an illustration of the lateral surface 12 and of the base collar 24, in the region of the skirt 20, which corresponds to the illustration from FIG. 4. The lateral surface 12 and the base collar 24 will therefore not be explained anew.

Figure 5A:
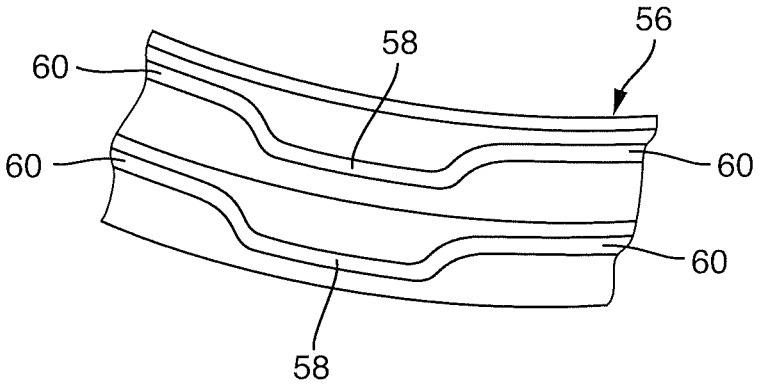
FIG. 5*a* shows a partial view of the pressing ram from FIG. 5, as seen obliquely from above.
Figure 5B:
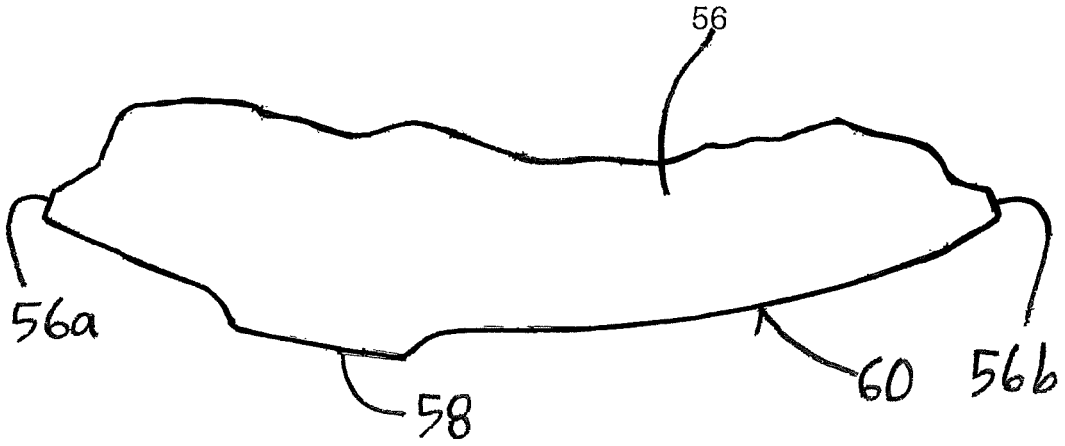
FIG. 5*b* shows a partial view of the pressing ram from FIG. 5 with terminal edges.

Instead of the pressing ram 54, however, part of a pressing ram 56 according to the invention is illustrated here. This pressing ram 56 has a radially outwardly projecting protrusion 58, which projects radially outwards in relation to the rest of the pressing surface 60 of the pressing ram 56. Further, as shown in FIG. 5*b*, the pressing ram 56 has spaced-apart terminal edges 56*a* and 56*b*, between which the pressing surface 60 extends.

This protrusion 58 is arranged, and dimensioned, such that it applies an increased pressure to the overlap 16 in its boundary portion, namely in the region of the cavity 50 in front of the second segment edge 30 on the outer side of the base collar 24. This makes it possible to ensure, once the skirt 20 has been pressed and sealed, that the cavity 50 is significantly smaller than in the case of conventional cups and is always completely filled with sealing material.

Figure 6:
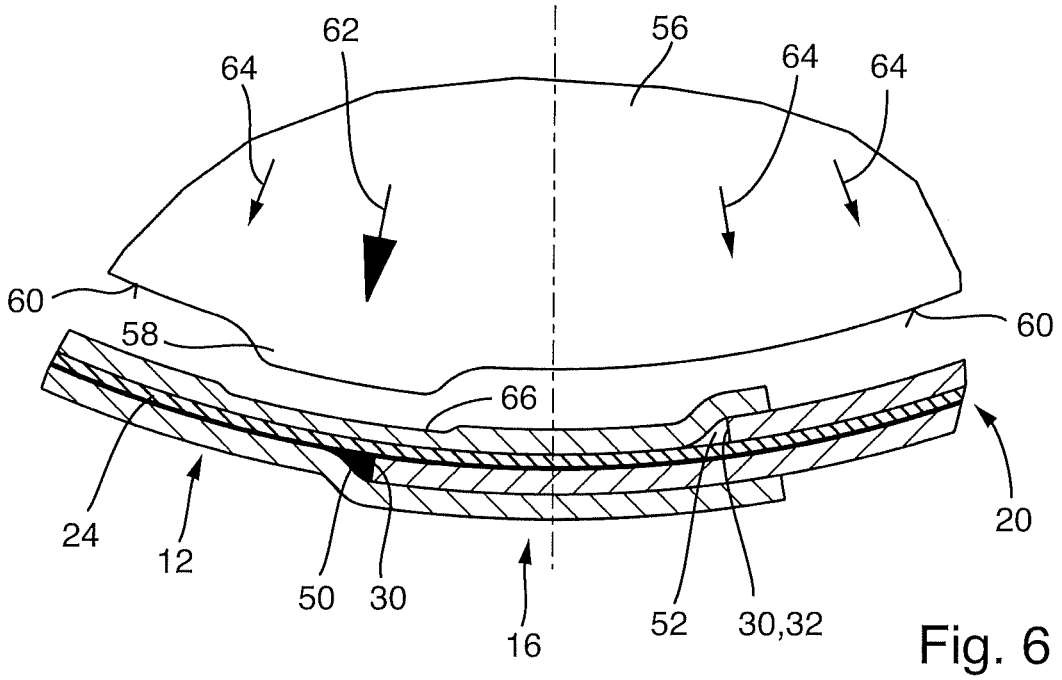
FIG. 6 shows the sectional view from FIG. 5 once the skirt has been subjected to pressing action, and therefore in the state in which the skirt is positioned on the completed cup.

The illustration of FIG. 6 shows the state once the skirt has been subjected to pressing action. As has already been explained, the skirt 20 is heated up, for example subjected to the action of hot air from the underside, in the not-yet-pressed state of FIG. 5. The pressing ram 56 then subjects the skirt to a radially outwardly directed pressure, which is symbolized in FIG. 6 by means of the arrow 62. It should be stated here that the pressing ram 56, or a plurality of pressing rams 56, applies, or apply, a radially outwardly directed pressure over the entire circumference of the skirt. On account of the protrusion 58 of the pressing ram 56, which projects radially outwards beyond the rest of the pressing surface 60 of the pressing ram 56, the pressure in the region of the protrusion 58, and thus in the region of the cavity 50 and in the boundary portion of the region of overlap, is nevertheless greater than in the region of the rest of the pressing surface 60. For clarification purposes, the arrow 62 has depicted alongside it in the circumferential direction somewhat shorter arrows 64, which are intended to symbolize the reduced pressure in the region of the rest of the pressing surface 60 of the pressing ram 56.

FIG. 6 shows the already definitively pressed and sealed state of the skirt 20. It can clearly be seen that the cavity 50 in front of the inner segment edge 30 on the outer side of the base collar 24 is completely filled with sealing material, this being illustrated by black ink in FIG. 6. In contrast, on the inner side of the base collar 24, the cavity 52 in front of the segment edge 30, in the region of the bevel 32, is not completely filled with sealing material, since here only the lower pressure has been applied radially outwards. As has already been mentioned, however, this cavity 52 is not critical as far as the sealing of the cup is concerned.

On account of the increased pressure in the region of the protrusion 58, the skirt 20 has a depression 66 on its inner side. The dimensions of the depression 66 correspond approximately to the dimensions of the protrusion 58.

The pressing ram 56 and thus the pressing surface 60 usually have a height which corresponds to the height of the skirt on the inner side of the skirt 20. In order to increase the pressure, the pressing surface 60 may also be designed in the form of one or more strips, see FIG. 5*a*. These strips can then each have a protrusion 58, which projects in the radial direction and performs the function of the protrusion 58 of the pressing ram 56 in FIG. 6, as is illustrated in FIG. 5*a*. If appropriate, it may also be sufficient then for just one of the strips to be provided with a protrusion.

Figure 7:
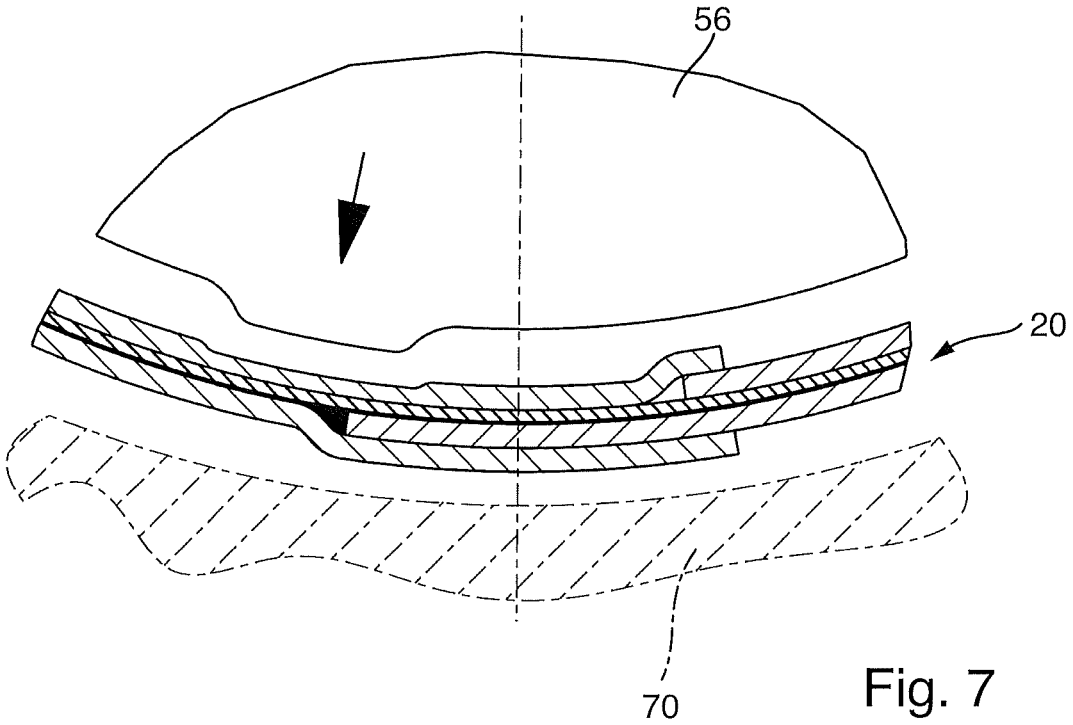
FIG. 7 shows the sectional view from FIG. 6, dashed lines depicting a counterpart which butts against the outer side of the skirt.

The illustration of FIG. 7 shows the cup in the region of the skirt 20 with the pressing ram 56 in the already pressed state of FIG. 6. The pressing ram 56 and skirt 20 will therefore not be explained anew.

On the outer side of the skirt 20, a counterpart 70 is arranged opposite the pressing ram 56. The counterpart 70 has a concave shaping, wherein the radius of this concave shaping corresponds approximately to the outer radius of the skirt 20. When the skirt 20 is subjected to pressing action, this counterpart 70 absorbs the pressure applied by the pressing ram 56.

Figure 8:
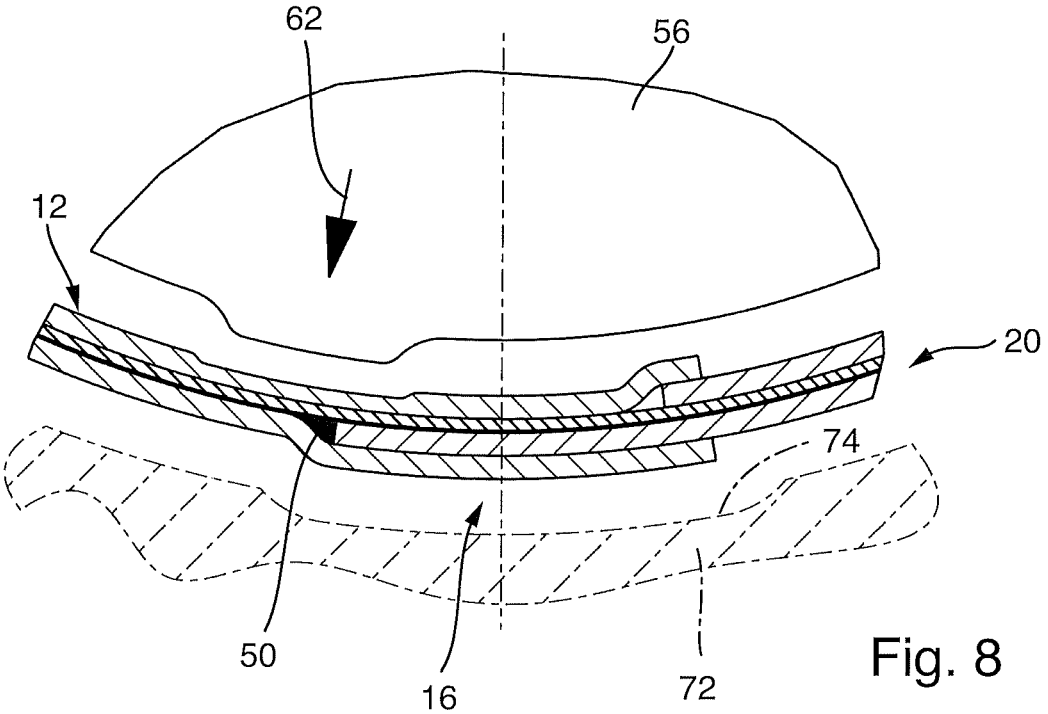
FIG. 8 shows the sectional view from FIG. 6, depicting a counterpart according to a further embodiment of the invention.

The illustration of FIG. 8 shows the arrangement of FIG. 7, the counterpart 70 being replaced by a counterpart 72 which, on its side which is directed towards the skirt 20, has a depression 74. The depression 74 is approximately as wide as the region of overlap 16 on the outer side of the skirt 20, said outer side being located at the bottom in FIG. 8. As a result of the depression 74, the region of overlap 16 can be accommodated in the counterpart 72 and the increased pressure in the region of the arrow 62 can be concentrated on the region of the cavity 50.

The depression 74 has rounded side edges, and this therefore avoids damage to the outer side of the skirt 20. The depression 74 has a depth which corresponds approximately to the material thickness of the segment 26 for producing the outer lateral surface 12. This can achieve reliable pressing and sealing in the region of the cavity 50 without there being any risk of the material of the lateral surface 12 being damaged by excessive pressure in the region of the overlap 16.

Figure 9:
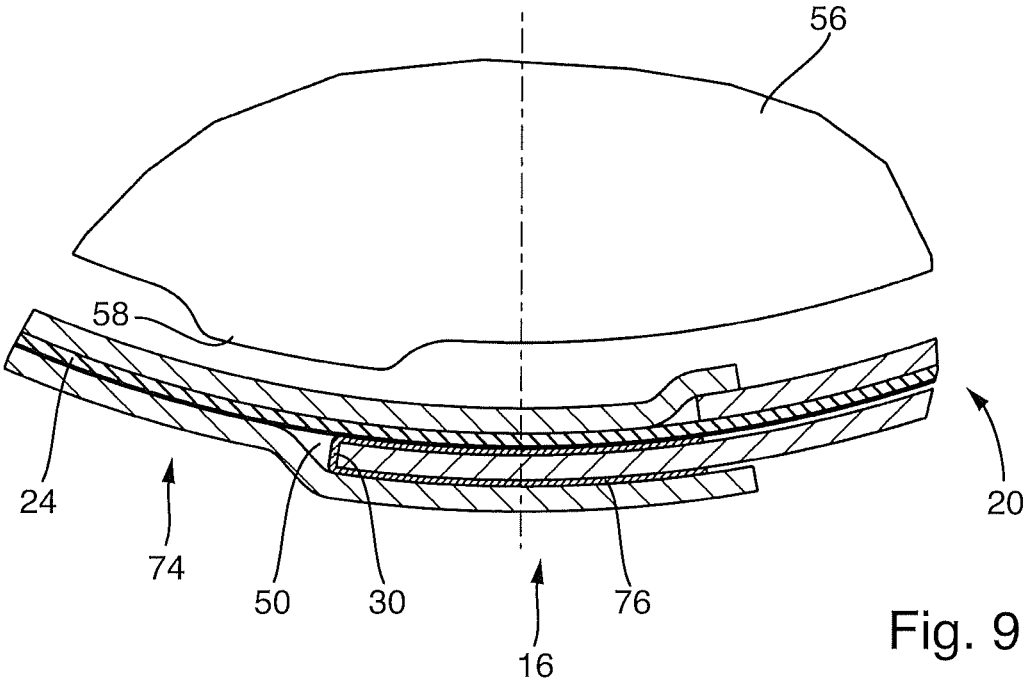
FIG. 9 shows a sectional view of a further embodiment of the container, with a section plane positioned along section plane A-A in FIG. 1.

The illustration of FIG. 9 shows a further embodiment of a container according to the invention. The illustration of FIG. 9 here constitutes a partial sectional view corresponding to FIG. 4, the section plane having been positioned in this through the skirt 20 in the same way as section plane A-A in FIG. 1. The pressing ram 56 has already been explained and has the protrusion 58.

In contrast to the lateral surface 12 from FIG. 4, the lateral surface 74 from FIG. 9 is formed from a segment of which the second segment edge 30 is provided with a sealing strip 76. The sealing strip 76 consists of a sealable thermoplastic, for example of polyethylene. The sealing strip 76 is folded around the second segment edge 30, and therefore the sealing strip thus extends some way along the region of overlap 16, on either side of the segment edge 30. Providing the sealing strip 76 means that, when the skirt 20 is subjected to pressing action, there is additional thermoplastic material available in order for the cavity 50 in front of the inner segment edge 30, which rests on the outer side of the base collar 24, to be completely filled with sealing material, that is to say in this case polyethylene. The provision of the sealing strip 76 thus makes it possible to provide for even more reliable sealing of the skirt 20 in relation to the interior of the container according to the invention.

Since that part of the second segment edge 30 which rests on the outer side of the base collar 24 extends from the skirt 20 into the interior of the container, the sealing strip 76 can prevent the open, cut edge along the segment edge 30 from coming into contact with liquid within the container. The sealing strip 76 is therefore used preferably in cans made of paper material, or paper-like material, which are intended to be filled, as cups, with liquid over a relatively long period of time. In the case of a can, rather than being connected just to the base collar 24 by means of the skirt 20, the lateral surface 74, as has already been explained in the introduction, would likewise be connected in a liquid-tight manner to a pan-like lid by means of a further skirt. It is also the case in the region of the skirt which connects the lateral surface 74 to the lid that the inner segment edge 30 is then provided with the sealing strip 76, in order also to achieve a particularly liquid-tight design of the skirt in the region of the lid.

The invention claimed is:

1. An apparatus for producing a container of sheet material, the container including a sheet segment wound about a longitudinal axis of the container to form a lateral wall of the container having segment edges disposed along opposite longitudinally extending sides of the sheet segment in overlapping relation with one another to form an overlap region of the container, and a pan-shaped termination element connected to the lateral wall in a liquid-tight manner by a skirt, the segment edges adjacent one end of the container each forming part of the skirt, one of the segment edges at the skirt being an inner segment edge located inwardly from and covered by the other segment edge at the skirt, the other segment edge being an outer segment edge, the outer segment edge being disposed radially outwardly from the inner segment edge to form a step on the skirt which forms part of a boundary portion of the overlap region of the container, the apparatus comprising at least one pressing ram disposed and configured to press and seal the skirt of the container, the pressing ram having first and second spaced-apart terminal edges and a pressing surface extending between and interconnecting the first and second terminal edges, the pressing surface being disposed to apply radially-directed pressure to the skirt of the container, the pressing surface having a single protrusion projecting radially outwardly beyond an entire remaining portion of the pressing surface disposed between the first and second terminal edges of the pressing ram such that the protrusion applies a pressure to the boundary portion of the overlap region of the container which is greater than pressure applied to the skirt by the entire remaining portion of the pressing surface.

2. The apparatus according to claim 1, wherein the pressing ram is oriented on a radially inner side of the skirt.

3. The apparatus according to claim 2, wherein the protrusion has a radially oriented outer surface having a convex curvature.

4. The apparatus according to claim 1, wherein the protrusion projects radially beyond the entire remaining portion of the pressing surface by an amount between 0.5 and 1.5 times a thickness of the sheet segment forming the lateral wall of the container.

5. The apparatus according to claim 1, wherein the protrusion projects radially beyond the entire remaining portion of the pressing surface by an amount substantially equal to a thickness of the sheet segment forming the lateral wall of the container.

6. The apparatus according to claim 1, wherein the protrusion has a width extending in a circumferential direction of the pressing surface by an amount between 0.25 and 0.75 times a width of the overlap region extending along a circumferential direction of the container.

7. The apparatus according to claim 1, wherein the protrusion has a width extending in a circumferential direction of the pressing surface by an amount of 0.5 times a width of the overlap region extending along a circumferential direction of the container.

8. The apparatus according to claim 1, wherein the protrusion is disposed circumferentially relative to the overlap region so as to apply pressure to only one of the segment edges in the overlap region at the skirt.

9. The apparatus according to claim 8, wherein the protrusion is disposed symmetrically relative to a periphery of the overlap region.

10. The apparatus according to claim 8, wherein the protrusion is disposed symmetrically relative to the one segment edge, the one segment edge butting against an outer side of the termination element.

11. The apparatus according to claim 1, wherein the protrusion is disposed circumferentially relative to the overlap region to apply pressure to only the inner segment edge, the inner segment edge butting against an outer surface of the termination element.

12. The apparatus according to claim 1, further including a counterpart disposed opposite the pressing ram and the skirt is disposed between the pressing ram and the counterpart, the counterpart comprising a depression disposed to accommodate the overlap region at the skirt.

13. The apparatus according to claim 12, wherein a width of the depression in a circumferential direction of the pressing surface is 0.5 to 1.5 times a width of the overlap region.

14. The apparatus according to claim 12, wherein a depth of the depression is 0.75 to 1.25 times a thickness of the sheet segment.

15. The apparatus according to claim 12, wherein a depth of the depression is substantially equal to a thickness of the sheet segment.

16. An apparatus for producing a container of sheet material, the container including a sheet segment wound about a longitudinal axis of the container to form a lateral wall of the container having segment edges disposed along opposite longitudinally extending sides of the sheet segment in overlapping relation with one another to form an overlap region of the container, and a pan-shaped termination element connected to the lateral wall in a liquid-tight manner by a skirt, the segment edges adjacent one end of the container each forming part of the skirt, one of the segment edges at the skirt being an inner segment edge located inwardly from and covered by the other segment edge at the skirt, the other segment edge being an outer segment edge, the outer segment edge being disposed radially outwardly from the inner segment edge to form a step on the skirt, the apparatus comprising at least one pressing ram disposed and configured to press and seal the skirt of the container, the pressing ram comprising first and second spaced-apart terminal edges and a pressing surface extending between and interconnecting the first and second terminal edges, the pressing surface being disposed to apply radially-directed pressure to the skirt of the container, the pressing surface including a single protrusion projecting radially outwardly beyond an entire remaining portion of the pressing surface disposed between the first and second terminal edges of the pressing ram such that the protrusion applies a pressure to the step of the skirt of the container which is greater than pressure applied to the skirt by the entire remaining portion of the pressing surface.

* * * * *